US011197354B2

(12) United States Patent
Reed et al.

(10) Patent No.: US 11,197,354 B2
(45) Date of Patent: Dec. 7, 2021

(54) SYSTEM AND METHOD FOR ELECTROMAGNETIC OVEN HEATING ENERGY CONTROL USING ACTIVE AND PASSIVE ELEMENTS

(71) Applicant: Spot Labs, LLC, Austin, TX (US)

(72) Inventors: James Weldon Reed, Austin, TX (US); Kareem Sameh Seddik, Austin, TX (US)

(73) Assignee: SPOT LABS, LLC, Austin, TX (US)

( * ) Notice: Subject to any disclaimer, the term of this patent is extended or adjusted under 35 U.S.C. 154(b) by 572 days.

(21) Appl. No.: 15/829,580

(22) Filed: Dec. 1, 2017

(65) Prior Publication Data

US 2018/0160487 A1 Jun. 7, 2018

Related U.S. Application Data

(60) Provisional application No. 62/428,553, filed on Dec. 1, 2016.

(51) Int. Cl.

| | |
|---|---|
| ***H05B 6/64*** | (2006.01) |
| ***H05B 6/70*** | (2006.01) |
| ***H05B 6/68*** | (2006.01) |
| ***H05B 6/66*** | (2006.01) |

(52) U.S. Cl.

CPC ..... *H05B 6/6438* (2013.01); *H05B 6/664* (2013.01); *H05B 6/686* (2013.01); *H05B 6/704* (2013.01)

(58) Field of Classification Search

CPC ..... H05B 6/00; H05B 6/64; H05B 6/6438; H05B 6/6441; H05B 6/6447; H05B 6/644; H05B 6/687; H05B 6/688; H05B 6/686; H05B 6/70; H05B 6/704

See application file for complete search history.

(56) References Cited

U.S. PATENT DOCUMENTS

| | | | | |
|---|---|---|---|---|
| 5,163,446 A * | 11/1992 | Saitoh | A61F 7/00 607/101 |
| 2009/0236335 A1* | 9/2009 | Ben-Shmuel | H05B 6/687 219/710 |
| 2013/0306627 A1* | 11/2013 | Libman | H05B 6/705 219/705 |

(Continued)

FOREIGN PATENT DOCUMENTS

| | | |
|---|---|---|
| CN | 101478902 A | 7/2009 |
| CN | 102484903 A | 5/2012 |
| DE | 2462409 A1 | 2/1977 |

(Continued)

OTHER PUBLICATIONS

International Search Report and Written Opinion for PCT/US2017/64293 dated Feb. 16, 2018, 10 pgs.

(Continued)

*Primary Examiner* — Erin Deery

(74) *Attorney, Agent, or Firm* — Sprinkle IP Law Group

(57) ABSTRACT

A selective heating device comprises a chamber configured to contain a target to be at least partially heated, an active electromagnetic (EM) element to generate an electromagnetic field in the chamber and a passive EM element in the chamber. The passive EM element is capable of electromagnetically coupling to the active element. The active EM element and passive EM element are controllable to selectively heat a portion of the target.

19 Claims, 11 Drawing Sheets

(56) References Cited

U.S. PATENT DOCUMENTS

2016/0192446 A1 6/2016 Seddik

FOREIGN PATENT DOCUMENTS

| | | | | |
|---|---|---|---|---|
| GB | 1159279 A | * | 7/1969 | ..... H05B 6/78 |
| KR | 2002-0070626 | | 9/2002 | |
| WO | WO 2015196218 A1 | | 12/2015 | |

OTHER PUBLICATIONS

International Preliminary Report on Patentability (IPRP) issued for International Application No. PCT/US2017/64293 dated Jun. 13, 2019, 8 pages.
Office Action with English translation for Chinese Patent Application No. 201780085169.3, dated Apr. 25, 2021, 20 pgs.

* cited by examiner

SYSTEM AND METHOD FOR ELECTROMAGNETIC OVEN HEATING ENERGY CONTROL USING ACTIVE AND PASSIVE ELEMENTS

RELATED APPLICATIONS

This application claims the benefit of priority under 35 U.S.C. § 119(e) to U.S. Provisional Patent Application No. 62/428,553, entitled "METHOD AND APPARATUS FOR ELECTROMAGNETIC OVEN HEATING ENERGY CONTROL," filed Dec. 1, 2016, which is hereby fully incorporated by reference herein for all purposes.

TECHNICAL FIELD

This disclosure relates generally to the field of heating devices. More specifically, the disclosure relates to systems and methods for controlling the heating energy of a microwave oven using active and passive elements.

BACKGROUND

Currently, conventional microwave ovens bombard food placed in a cavity with electromagnetic energy that causes food to heat through the process of dielectric heating. For example, conventional microwave ovens use a magnetron to emit electromagnetic waves in a cavity. This creates standing waves inside the cavity that heat all food items within the cavity. Conventional microwave ovens are thus unable to target specific regions within the cavity. On the other hand, the standing wave pattern forms areas of high and low energy concentrations, thus creating non-uniform heating of foods or materials inside the conventional microwave ovens. Conventional microwave ovens attempt to mitigate uneven distribution through the use of a variety of methods, such as motorized rotating dishes or microwave stirrers that randomize the standing waves patterns.

Conventional microwave ovens are popular for reheating previously cooked foods, leftovers, and even frozen meals. However, these food items may contain several different foods or dishes that the user would rather not heat or heat to different temperatures. For example, a user may have a salad, broccoli, and potatoes on the same dish. In this instance, the user may wish to only heat the potatoes, slightly warm the broccoli and not heat the salad. Conventional microwave ovens currently on the market are unable to selectively heat specific food items or areas within the oven's cavity, as all the food items inside the conventional microwave oven's cavity are subject to the electromagnetic standing waves present in the oven's cavity. As a result, in this example, the user is forced to separate out his foods into separate dishes and heat each dish separately.

SUMMARY

Embodiments described herein provide systems and methods to selectively heat portions of a target in a microwave oven. One embodiment comprises a chamber configured to contain a target to be at least partially heated, an active electromagnetic (EM) element to generate an electromagnetic field in the chamber and a passive EM element in the chamber. The passive EM element is capable of electromagnetically coupling to the active element. The active EM element and passive EM element are controllable to selectively heat a portion of the target.

Another embodiment comprises a computer program product comprising a non-transitory computer readable medium storing a set of computer executable instructions, the computer executable instructions executable to perform a method comprising receiving a heating instruction to heat a portion of a target in an oven cavity and controlling an active EM element to generate an electromagnetic field in an oven cavity and a passive EM element in the oven cavity that is controllable to electromagnetically couple with the active EM element to selectively heat the portion of the target.

A further embodiment includes a method for selective heating. The method includes receiving a heating instruction to heat a portion of a target in an oven cavity and controlling an active EM element to generate an electromagnetic field in an oven cavity and a passive EM element in the oven cavity that is controllable to electromagnetically couple with the active EM element to selectively heat the portion of the target.

One embodiment includes a selective heating device comprising a chamber configured to contain a target to be at least partially heated. The selective heating device further comprises an active EM element to generate an electromagnetic field in the chamber and a passive EM element having a controlled impedance, the impedance of the passive EM element controllable to selectively couple electromagnetically with the active EM element to control the shape of the electromagnetic field. The device may further comprise a controller configured to control a power signal to the active element and the impedance of the passive element to selectively heat a portion of the target.

Another embodiment of a selective heating device comprises a chamber configured to contain a target to be at least partially heated, an element network and a controller. The element network comprises a plurality of active EM elements configured to generate respective electromagnetic fields in the chamber and a plurality of passive EM elements, each of the plurality of passive EM elements having a controlled impedance. The impedance of each passive EM element is controllable to selectively electromagnetically couple that passive EM element to at least one active EM element. The controller is configured to control power signals to the plurality of active EM elements and the impedances of the plurality of passive EM elements to create an electromagnetic field with a controlled shape to selectively heat a portion of the target.

One embodiment of a heating method can comprise receiving a heating instruction to heat a portion of a target in an oven cavity, driving an active EM element to generate a polarized electromagnetic field in the oven cavity and selectively controlling the impedances of a plurality of passive EM elements that are controllable to electromagnetically couple to the active element to create an electromagnetic field with a controlled shape about the portion. The electromagnetic field with the controlled shape is adapted to selectively heat the portion of the target.

BRIEF DESCRIPTION OF THE DRAWINGS

The drawings accompanying and forming part of this specification are included to depict certain aspects of the invention. A clearer impression of the invention, and of the components and operation of systems provided with the invention, will become more readily apparent by referring to the exemplary, and therefore non-limiting, embodiments illustrated in the drawings, wherein identical reference numerals designate the same components. Note that the features illustrated in the drawings are not necessarily drawn to scale.

DETAILED DESCRIPTION

Figure 1:
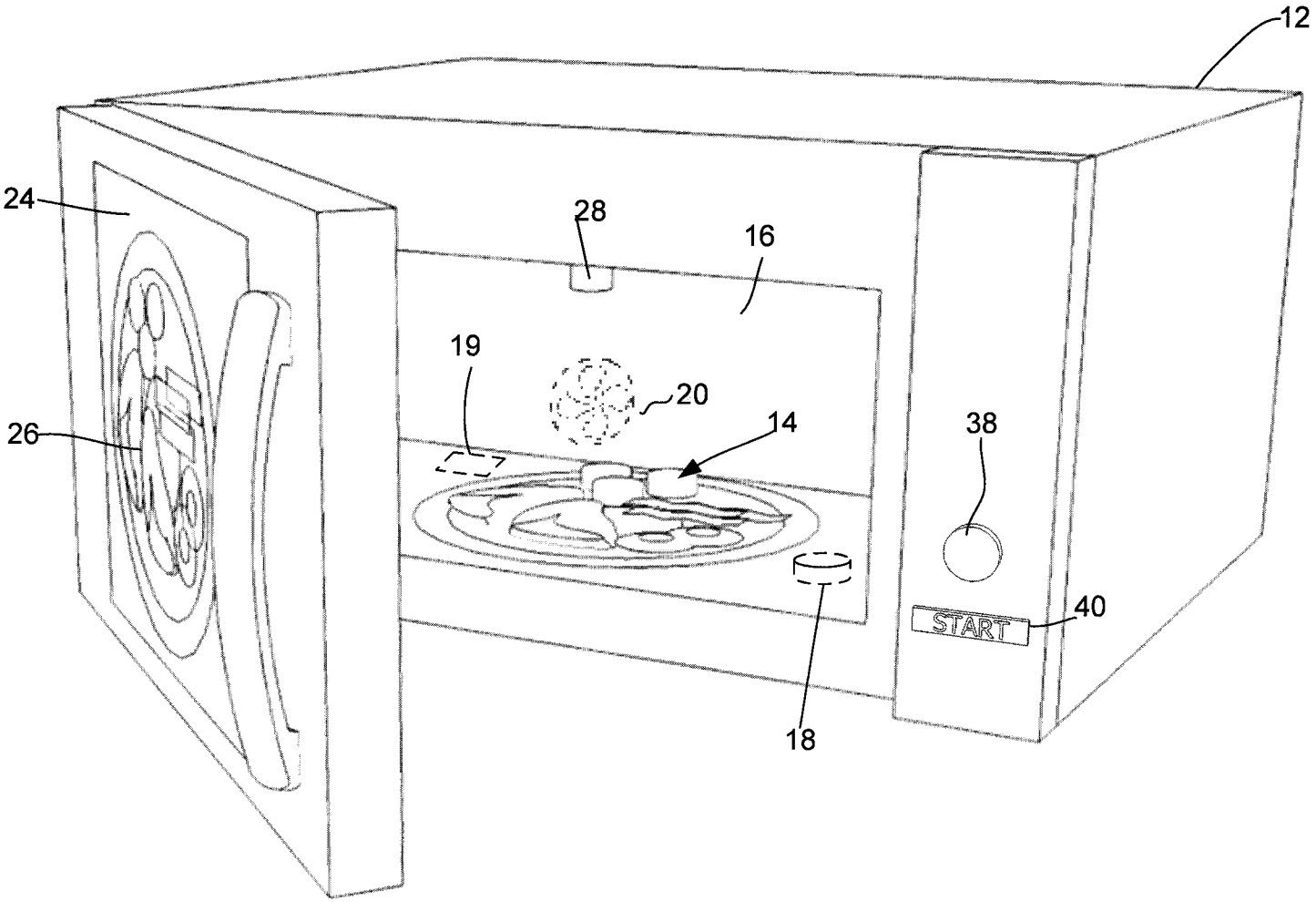
FIG. 1 is a perspective view of a selective heating electromagnetic oven according to an embodiment of the disclosed systems and methods.

The invention and the various features and advantageous details thereof are explained more fully with reference to the non-limiting embodiments that are illustrated in the accompanying drawings and detailed in the following description. Descriptions of well-known starting materials, processing techniques, components, and equipment are omitted so as not to unnecessarily obscure the invention in detail. It should be understood, however, that the detailed description and the specific examples, while indicating some embodiments of the invention, are given by way of illustration only and not by way of limitation. Various substitutions, modifications, additions, and/or rearrangements within the spirit and/or scope of the underlying inventive concept will become apparent to those skilled in the art from this disclosure.

Embodiments described herein provide systems and methods to create desired energy patterns within the cavity of a microwave oven, thus allowing a user to selectively heat specific areas of a food item(s) or other target(s). The systems and methods described herein perform selective heating of foods using electromagnetic energy. In one example embodiment, a number of active elements may be placed in specific locations relative to the cavity of an oven. Each active element is powered by a power source and generates an electromagnetic field in its vicinity. A number of passive microwave elements with controlled impedance are also positioned relative to the oven cavity. The passive elements are controllable to selectively couple with the electromagnetic field emitted by one or more active elements to create desired electromagnetic field patterns in the oven cavity to selectively heat portions of the food in the cavity. In addition to providing control to selectively heat portions of a target, embodiments herein reduce cost by reducing the number of active elements.

According to one embodiment, a user may choose to heat different food items within the cavity of the oven to different temperatures without having to run the oven through multiple heat cycles. The oven may include a user interface and camera mounted inside the oven cavity that allow a user to select food items or areas of food items to be heated on a touch-screen display. The oven may include a system that captures the user's selections and utilizes the captured data to control a heating system capable of directing electromagnetic energy to any area of the food. Selectively directing the energy to certain areas allows the heating system to only heat the selected areas.

In addition or in the alternative, systems and methods described herein may include a method for allowing food manufacturers to create and store heat maps on a printable sticker or other label that can later be read by the oven and used to heat the food. The methods and systems described herein may include a machine readable code, such as a QR code or bar code, that can be attached to a food tray. The sticker may contain information about the locations and temperatures to be heated. A smart oven may automatically read the code and heat the food per the specified heat map. The smart oven may, for example, access a pre-stored heat map based on the code or download a heat map associated with the code from the manufacturer. Thus, dinner food manufactures manufacturers may have more advanced control over how their food is heated and users may have a fully one-button automatic heating solution.

Furthermore, the methods and systems described herein may go beyond the kitchen and food space to include other industrial and commercial applications such as materials manufacturing. Thus, the target may be any item(s) that can be heated by the oven.

FIG. 1 is a perspective view of a selective heating electromagnetic oven or other heating system 12 according to an embodiment of the disclosed systems and methods. The system 12 comprises an oven cavity 16. In one embodiment, the oven cavity may comprise a plurality of cavities. For example, system 12 may include a microwave cavity 16 configured to prevent or minimize leakage of microwaves generated in the cavity 16 and an inner cavity formed by a liner to provide an aesthetic appearance (e.g., to cover electronic components) and support food. Cavity 16 is defined by a set of cavity walls, a cavity ceiling and a cavity floor. The walls, floor and ceiling, in some embodiments, are coated to prevent standing waves. At least one of the cavity walls may be at least partially formed by a portion of the heating system's door. The heating system 12 is configured for enabling a user to selectively heat food items 14, or other materials, within microwave oven cavity 16.

The user may interact with the system 12 through an interface 24 that includes a touch screen that displays an image 26 of the food items 14 inside the cavity 16 of the system 12. The image 26 of the food items 14 that are inside the cavity 16 of the system 12 is captured using a camera 28 located inside the system 12, or other device that may be used to measure and display to the user a graphical representation of the materials inside the system 12. The fan 20 may operate to create suction inside the cavity to expel hot air that may heat food areas via convection that the user may not want to heat or the fan or similar system may be used to create a vacuum inside the cavity to reduce the effects of convection. In addition or in the alternative, the fan 20 may operate in the other direction to stir hot air in cavity 16 for enhanced convection and food texture. A heater element may be placed in the fan for added forced air convection.

The heating system 12 includes one or more active electromagnetic (EM) elements 18 ("active elements") (one is illustrated) and passive EM elements 19 ("passive elements") (one is illustrated) that are placed relative to the cavity 16. According to one embodiment, active elements 18 are active resonators and passive elements 19 are passive resonators. The active elements 18 and passive elements may be placed in the oven cavity 16. By way of example, but not limitation, active elements 18 and passive elements 19 may be placed between a cavity wall and a liner that covers the elements from view when the oven door is opened.

Active elements 18, which may be connected to solid state amplifiers, generate localized microwave fields in oven cavity 16. Passive elements 19, which are placed relative to the active element elements 18, are capable of electromagnetically coupling with active elements 18 to extend the field region from active elements 18 toward the passive elements. That is, each passive element 19 is capable of accepting and spatially extending microwave energy from one or more active element 18. In essence, this manipulates the field distribution without the need for a high number of active solid state devices. Passive elements 19 do not require power to couple to active elements 18. However, a non-powered passive element 19 may be connected to other components that are powered for control purposes. As discussed further below, electromagnetic coupling of a passive element 19 to an active element 18 can be controlled by controlling a varying impedance of the passive element 19, a polarization scheme and the power level of the signals driving the active element 18.

Through coupling, active elements 18 and passive elements 19 work together to control how the microwave fields are distributed in the cavity 16. The microwave fields heat the food or other target in proximity to coupled active elements 18 and passive elements 19. The shape of electromagnetic fields in cavity 16 is controlled to selectively heat different portions of the food or other target. Control of the microwave pattern within the cavity is achieved through the placement of active elements 18 and passive elements 19 along the cavity floor, ceiling or side walls, the control of the impedance values of the various passive elements 19, control of the polarization scheme of each active and passive element, and controlling the power level of the signals driving the active elements 18.

According to one embodiment, each active element 18 is configured to produce microwaves of a wavelength suitable for cooking food in cavity 16. For example, the active elements may have a frequency of 2.4-2.5 GHz. Furthermore, while a microwave cavity may have a number of resonant modes, active elements 18 can be configured not to create radiating waves and not excite resonant modes inside the metal oven cavity (not excite the cavity's resonant modes). In addition, active elements 18 can be configured to create electromagnetic fields in their near vicinity and hence only heat food exposed to their near proximity. In one example embodiment, a number of RF 2.4 GHz electromagnetic elements 18 are placed in specific stationary locations on the bottom floor of the oven cavity 16. The active elements 18 can be configured to produce non-radiating electromagnetic fields in their near vicinity. For example, according to one embodiment, each active element 18 is configured to produce an electromagnetic field of approximately 1 cubic inch in volume above the element and no other energy excitations in the cavity 16. In other embodiments, active elements may be configured to produce electromagnetic fields of different volumes.

The active element may include one or more terminals to which power can be connected. Power signals are selectively applied to the one or more terminals of each active element 18 to cause the active element 18 to generate an electromagnetic field in cavity 16. The polarization of an active element 18 can be dependent on the amplitudes and phases of signals applied to multiple terminals of an active element. Thus, the power, amplitude and phase of the power signals driving each active element 18 can be controlled to create various power and polarization schemes. According to one embodiment, multiple amplifiers are coupled to each active element to provide multiple power signals such that element 18 can produce an electromagnetic field with vertical and horizontal polarizations with independent amplitude and phase. By controlling the input signals, the horizontal and vertical amplitude and phase can be controlled to produce a variety of polarization schemes including horizontal polarization, vertical polarization, 45-degree-slant polarization, circular polarization or elliptical polarization. In other embodiments, the polarization of one or more active elements 18 is fixed.

Each passive resonator 19 is positioned to be within a region of a respective active resonator 19 and can be controlled to selectively couple to the energy of the respective active resonator. As noted above, the oven 12 can be configured so that the electromagnetic fields produced by an active resonator do not escape into far fields. Accordingly, a passive resonator 19 can be spaced to be in the reactive near-field region or, in some cases, radiating near-field region of a respective active resonator 18. In other embodiments, a passive element 19 may be positioned in cavity 16 such that the passive element 19 is in the far field region of an active element 18 with which it couples.

Passive elements 19 are terminated with variable impedance values, including, but not limited to variable reactance values. Each passive element 19 may have one or more terminals coupled to independently controllable impedances. For example, each passive element may have one or more terminals with each terminal connected to an impedance control circuit that is controllable to vary the impedance at the respective passive element terminal. In one embodiment, the impedance control circuit comprises one or more circuit components between a respective passive element terminal and ground. According to one embodiment, the impedance control circuit may comprise a switch. When the switch is open, the corresponding passive element 19 terminal terminates at an open circuit with infinite impedance. When the switch is closed, the terminal impedance is near zero or other impedance controlled by the impedance control circuit. The terminal impedance(s) applied to the passive element, can be controlled to selectively induce coupling of energy from an active element 18 can couple with the passive element 19 assuming compatible polarization and that the passive element 19 being within the electromagnetic field of the active element 18. Switching (e.g., on or off) can provide binary terminal impedance values. In some embodiments, the impedance control circuit may comprise one or more components that are controllable to provide a range of impedance values. For example, a passive element 19 may be coupled to an impedance control circuit comprising a variable capacitor, variable capacitance diode (e.g., a varactor), a variable impedance microelectromechanical system (MEMS), or other component that is controllable to control the impedance of the passive element 19 through a range of values. For example, a control voltage may be applied to a varactor of an impedance control circuit such that the passive element has a specific load and, hence, terminal impedance value. Each passive element 19 can be capable of coupling with the energy from one or more respective active elements 18. In some embodiments, one or more terminals of an active element are also coupled to an impedance control circuit that can be controlled to further control the field generated by the active element 18.

The polarization of a passive element may be fixed or adjustable. For a passive element 19 with adjustable polarization, the polarization of the passive element can be dependent on the impedances at multiple terminals of the passive element. According to one embodiment, a passive element 18 may have multiple terminals connected to impedance control circuits. The terminal impedance values for each terminal can be controlled to control the polarization of the passive element.

To control which areas of the food 14 are heated, power signals to active elements 18 and the terminal impedance values of passive elements 19 are controlled to selectively couple passive elements 19 to produce appropriate electromagnetic fields. For example, a network of impedance control circuits may be controlled to selectively apply terminal impedance values to passive elements 19 tuned to couple with the energy created by the active elements 18.

Additionally, controlling the polarization scheme of the active elements 18 and the passive elements 19 allows the energy emitted by a particularly polarized active element 18 to couple with only those passive elements 19 of the same polarization. As noted above, the polarization scheme of an active element 18 or passive element 19 may be controlled at runtime. According to one embodiment, the signal power and polarization scheme of each active element 18 is controlled by a controller and the passive elements 19 are specifically polarized, either through having a fixed polarization or an adjustable polarization, to only couple with energy from an active element 18 that is polarized the same. Consequently, a passive element 19 can be on, yet will not couple with energy that is not at the same polarization (see e.g., FIG. 2D). This gives a high degree of control over the shapes created and the ability to create multiple independent shapes within the same cavity. Polarization thus provides another degree of control. Moreover, adjusting the power levels driving the active elements 18 provides yet another degree of control because higher power levels results in faster heating and more coupling.

An embedded controller, such as a microcontroller (not shown), may capture an input and convert the input into control signals to control the power signals to active elements and the impedance of passive elements 19. In some embodiments, the controller may control the polarization scheme of active elements 18 and passive elements 19. For example, if only one quadrant of a dish needs to be warmed up, then an active element 18 in that area may be activated and the terminal impedance values of nearby passive elements 19 can be controlled so that nearby passive elements 19 with compatible polarizations couple with the energy of the active element 18, thus coupling energy between the active and passive elements. The elements can be controlled to create an energy pattern of a controlled shape, such as a shape that resembles a quarter circle or other shape, in the desired area to be heated. Thus, a network of active elements 18 and passive elements 19 can be controlled to create an electromagnetic field with a shape that can be dynamically adjusted by changing the power signals to the active elements and the impedance values of the passive elements. Consequently, system 12 can control heating at specific areas within cavity 16.

Figure 2A:
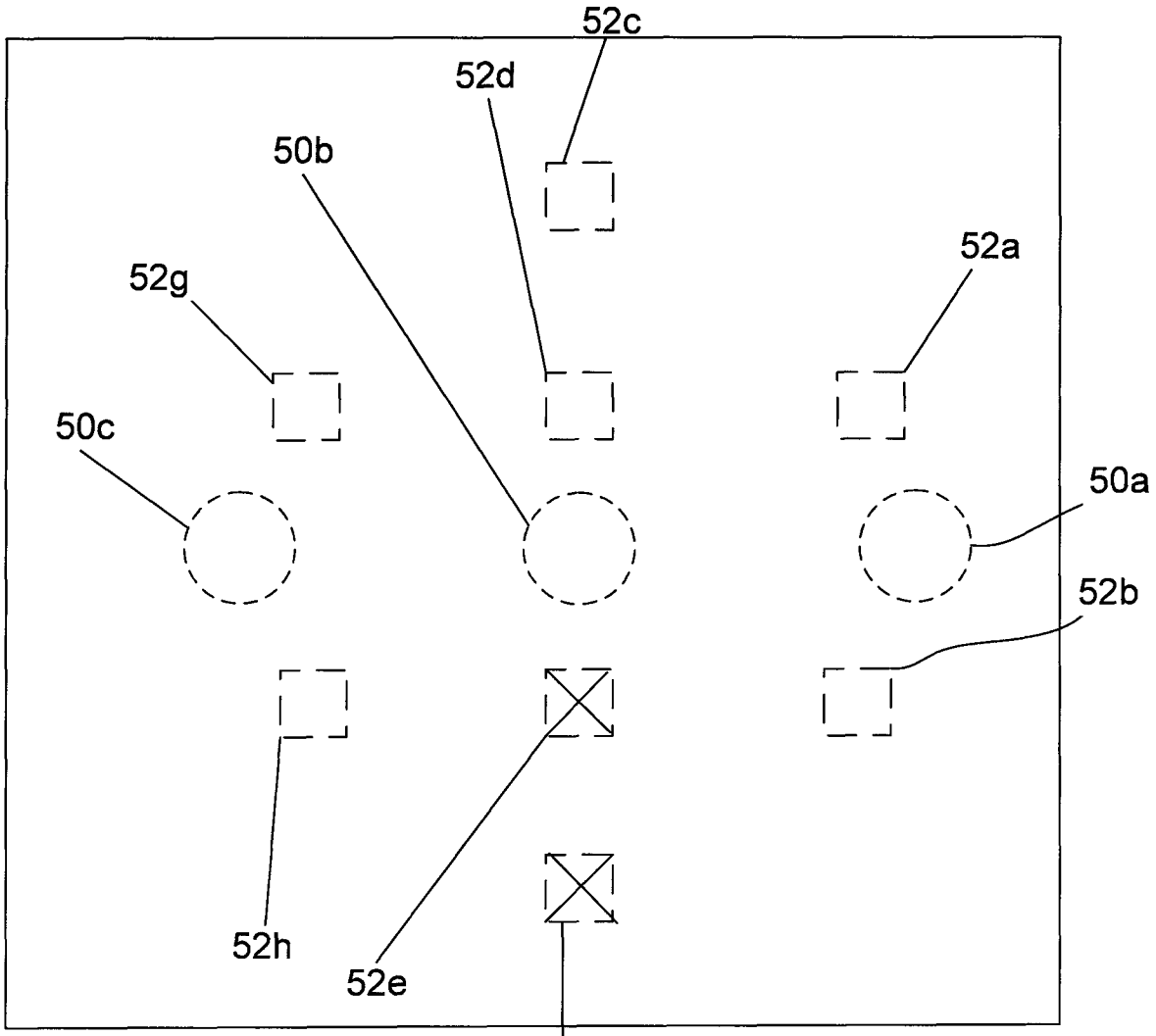
FIG. 2A is a diagrammatic representation of one embodiment of an element network.

Active and passive EM elements may be arranged in a variety of patterns. For example, FIG. 2A illustrates one example network of active elements and passive elements that can be used in system 12 or other heating system. The heating system comprises a network of active elements 50 (shown individually as active elements 50*a*, 50*b* and 50*c*) and passive elements 52 (shown individually as passive elements 52*a*-52*h*). Active elements 50 and passive elements 52 may be examples of active elements 18 and passive elements 19, respectively. According to one embodiment, active elements 50 are active resonators and passive elements 52 are passive resonators.

Active elements 50 and passive elements may be switched between on and off states. An active element 50 that is on has power driving it and may be at a specific polarization (either fixed or dynamic). An active element 50 that is off does not have power driving it to generate an electromagnetic field in the oven cavity. A passive element 52 that is "on" when it is configured to electromagnetically couple with an active element. In some embodiments, a terminal impedance may be applied by controlling an impedance control circuit. For example, according to one embodiment, the terminal impedance value of a passive element 52 can be controlled by closing a switch to the passive element 52 to complete a terminal circuit. Furthermore, in some embodiments, a passive element 52 may be coupled to a varactor or other component that allows the impedance of the passive element 52 to be dynamically controlled through a range of impedance values. A passive element 52 may have terminal impedances applied to multiple terminals to control polarization of the passive element. Thus, in some embodiments, a passive element 52 that is on may have a specific load applied to control impedance. According to one embodiment, a passive element 52 can be turned off by opening one or more switches coupled to the passive element to create infinite impedance in the passive element. A passive element that is off may have no load applied.

The active elements 50 in the example of FIG. 2A are configured to create microwave electromagnetic fields suitable for cooking food in cavity 16. For example, elements 50 can be configured to create a 2.4 GHz-2.5 GHz polarized electromagnetic field and to not excite resonant modes in the microwave oven cavity. As a more particular example, active elements 50 can be configured to provide a 2.4 GHz polarized electromagnetic field within their immediate vicinity and to not excite modes in the oven cavity. The passive elements 52 can be controlled to couple with the electromagnetic fields created by the active elements 50. That is, each passive element 52 can be tuned to the frequency and polarization of at least one active element 50.

Figure 2B:
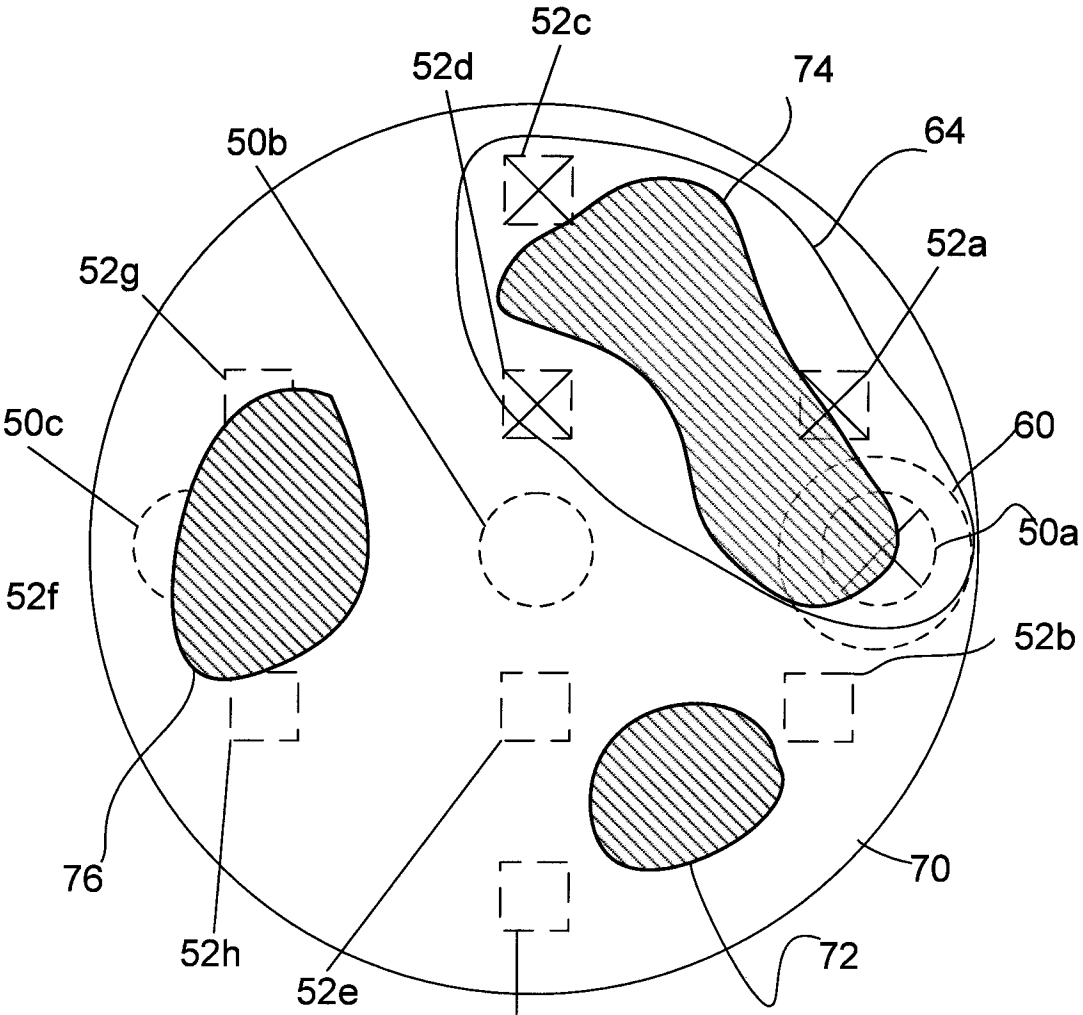
FIG. 2B is a diagrammatic representation of one embodiment of a set of food items positioned relative to an element network and an electromagnetic field with a controlled shape applied to the set of food items.

FIG. 2B is a diagrammatic representation of a top-down view of a plate 70 holding a target comprising food items 72, 74, 76 placed in one embodiment of a heating system. In the example of FIG. 2A, it is desired to heat food item 74, but not food item 72 or food item 76. As such, active element 50*a* is switched on and active elements 50*b*, 50*c* are switched off. Active element 50*a*, when switched on and without the influence of passive elements 52, will create a polarized electromagnetic field 60 in the vicinity of active element 50*a*. According to one embodiment, a food item in field 60 may be heated. Thus, a selective heating system, in one mode of operation, may heat a portion of a target solely using active elements.

In addition, passive elements 52*a*, 52*c* and 52*d* are on—that is the terminal impedances of passive elements 52*a*, 52*c*, 52*d* are controlled to induce electromagnetic coupling between the passive elements and at least one active element—while passive elements 52*b*, 52*e*-52*h* are left open (turned off) (e.g., terminate at open switches to have infinite terminal impedance values). Because passive elements 52*a*, 52*c* and 52*d* are tuned to the active element 50*a* and switched on, the electromagnetic field produced by active element 50*a* will couple with passive elements 52*a*, 52*c* and 52*d*, but not passive elements 52*b*, 52*e*-52*h*, which are switched off. This will result in the electromagnetic field extending beyond the active element 56 to create electromagnetic field 64. The electromagnetic field 64 will cause heating of food item 74, but not 72 or 76. While electromagnetic field 64 is illustrated with well-defined edges, this is for the sake of illustration. One of ordinary skill in the art will appreciate that field 64 is depicted for clarity in FIG. 2B and that the controlled shape created by electromagnetic coupling of active element 50*a* with passive elements 52*a*, 52*c*, 52*d* may not be as sharp as depicted.

As can be understood from the example of FIG. 2B, an electromagnetic field 64 can be created in a desired area by controlling the impedance of passive elements 52, for example, by controlling the impedance at one or more terminals of passive elements 52*a*, 52*c*, 52*d* to have a first impedance value, but terminating passive elements 52*b*, 52*d*-52*g* with a second impedance value (e.g., infinite impedance or other impedance value that prevents coupling of passive elements 52*b*, 52*d*-52*g* with active element 50*a*). In one embodiment, the shape of electromagnetic field 64 may be further fine-tuned to match the shape of food item 74 by adjusting the individual impedance values of each of the passive elements 52*a*, 52*c*, 52*d*. For example, different loads can be applied to impedance control circuits connected to passive elements 52*a*, 52*c*, 52*d* to adjust the impedance of each passive element 52*a*, 52*b*, 52*c*. Moreover, the signal power driving the active element 50*a* can be adjusted, providing more control over the shape and strength of the electromagnetic field 64. Moreover, through adjusting the polarization scheme of the electromagnetic field created by the active element 50*a* and the way the passive elements 52 are polarized, the shape of the electromagnetic field 58 can also be further adjusted. Moreover, through adding metal strips or directors in the cavity floor (not shown), the shape of electromagnetic field 64 can be further adjusted.

Figure 2C:
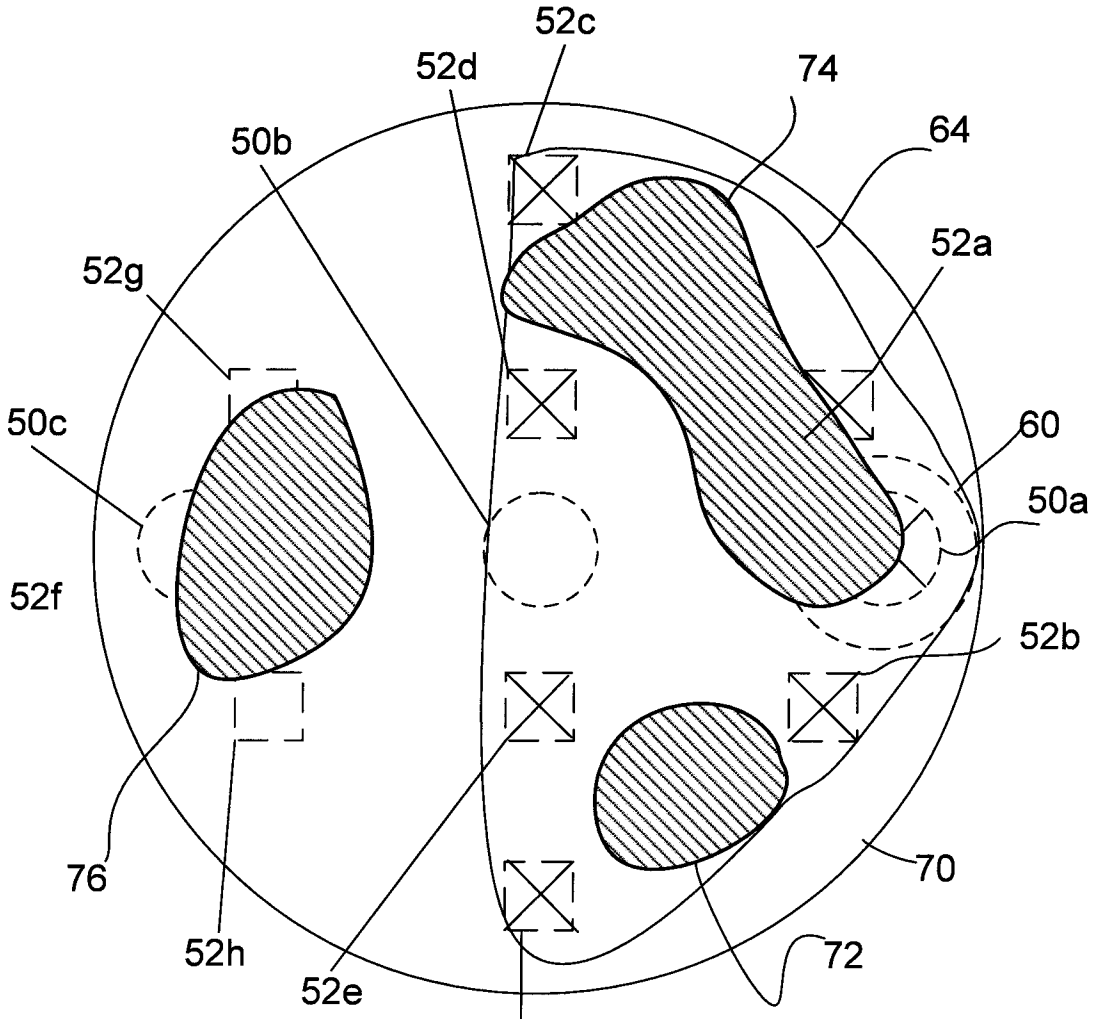
FIG. 2C is a diagrammatic representation of one embodiment of a set of food items positioned relative to an element network and another embodiment of an electromagnetic field with a controlled shape applied to the set of food items.

Turning briefly to FIG. 2C, FIG. 2C shows an example embodiment in which it is desirable to also heat food item 72. In this case, passive elements 52*b*, 52*e* and 52*f* can also be turned on to reshape the electromagnetic field 64 as illustrated. It can be noted that passive elements 52*b*, 52*e* and 52*f* may be on for a different period of time than elements 52*a*, 52*c*, 52*d*. Thus, FIG. 2C illustrates an example in which the active EM elements and the passive EM elements are controllable to selectively heat a first portion of the target at a first energy level for a first period of time, selectively heat a second portion of the target at a second energy level for a second period of time and refrain from heating a third portion of the target.

Figure 2D:
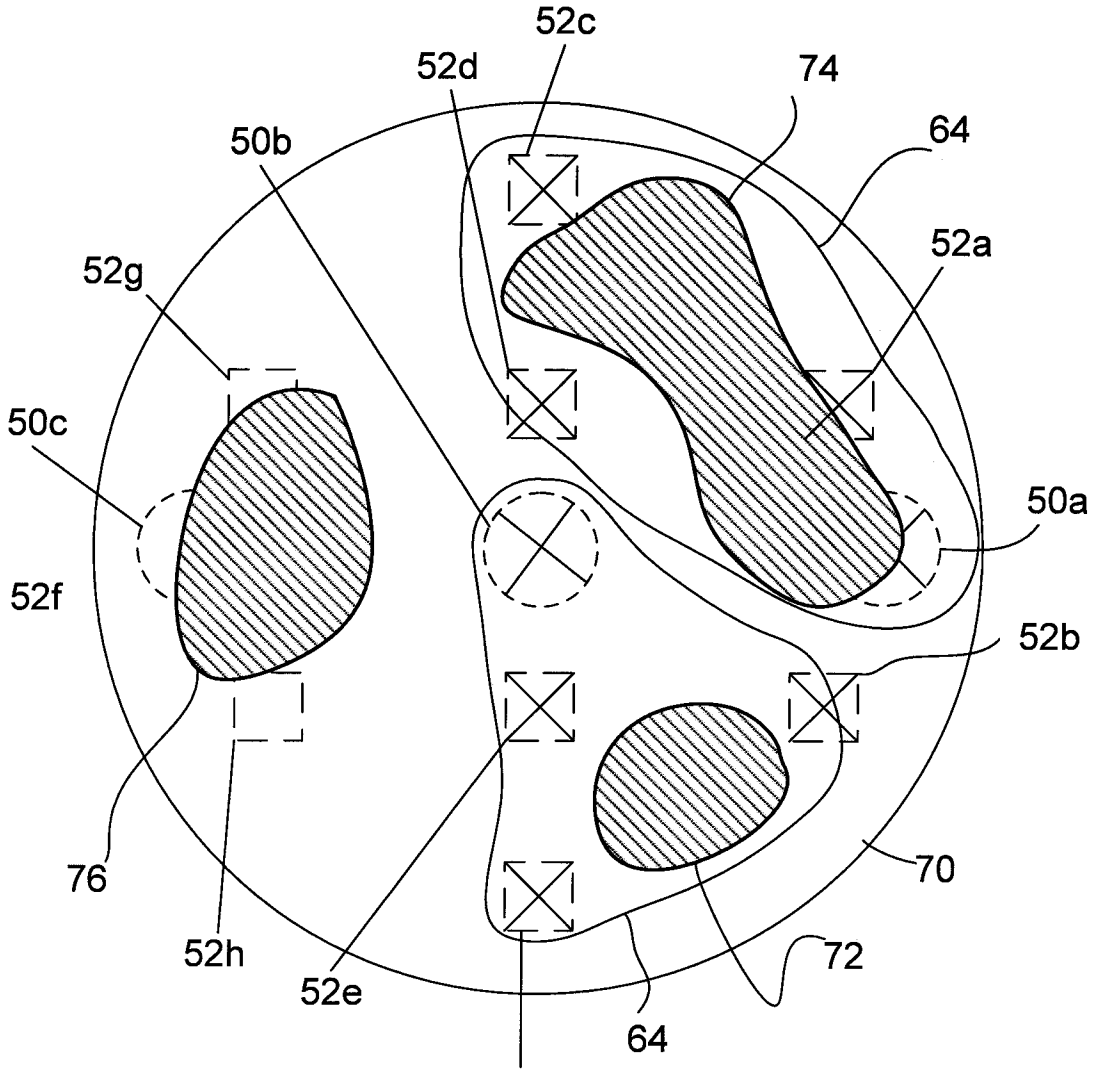
FIG. 2D is a diagrammatic representation of one embodiment of a set of food items positioned relative to an element network and a plurality of electromagnetic fields with controlled shapes applied to the set of food items.

Referring to FIG. 2D, another example of heating food items 72 and 74 is illustrated. In this example, active elements 50*a* and 50*b* are turned on and, similar to FIG. 2C, passive elements 52*a*-52*f* are turned on. However, in this example, passive elements 52*a*, 52*c* and 52*d* are polarized to match a first polarization scheme and passive elements 52*b*, 52*e* and 52*f* are specifically polarized for a second polarization scheme. For example, the terminal impedances at multiple terminals of passive element 52*a*, 52*c* and 52*d* are controlled for a first polarization and the terminal impedances are controlled for multiple terminals of passive elements 52*b*, 52*e* and 52*f* are controlled for a second polarization. Moreover, active elements 50*a* and 50*b* are on with different polarizations. For example, the power signals of elements 50*a* and 50*b* are controlled by a microprocessor so that active element 50*a* has a polarization scheme that matches elements 52*a*, 52*c*, 52*d* and active element 50*b* has a polarization scheme that matches elements 52*b*, 52*e* and 52*f*.

In the example of FIG. 2D, passive elements 52*a*, 52*c*, 52*d* are polarized to match the polarization of active element 50*a* and passive elements 52*b*, 52*e* and 52*f* are polarized to match the polarization of active element 50*b*. Consequently, elements 52*a*, 52*c*, 52*d* will electromagnetically couple with active element 50*a* to extend the field region from active element 50*a* to create electromagnetic field 64 as discussed above with respect to FIG. 2B. Moreover, passive elements 52*b*, 52*e* and 52*f* will couple with active element 50*b* to extend the field region from active element 50*b* to create electromagnetic field 62 that heats food item 72. The electromagnetic field produced by active element 50*a* is not extended by passive elements 52*b*, 52*e*, 52*f* because passive elements 52*b*, 52*e* and 52*f* are not tuned to the polarization of active element 50*a*. Likewise, the electromagnetic field produced by active element 50*b* is not extended by passive elements 52*a*, 52*c* and 52*b* because of the different polarizations. Note that different power levels can be applied to active elements 50*a* and 50*b* such that fields 62 and 64 have different heating characteristics. Thus, FIG. 2D illustrates another example in which the active EM elements and the passive EM elements are controllable to selectively heat a first portion of the target at a first energy level for a first period of time, selectively heat a second portion of the target at a second energy level for a second period of time and refrain from heating a third portion of the target.

Figure 2E:
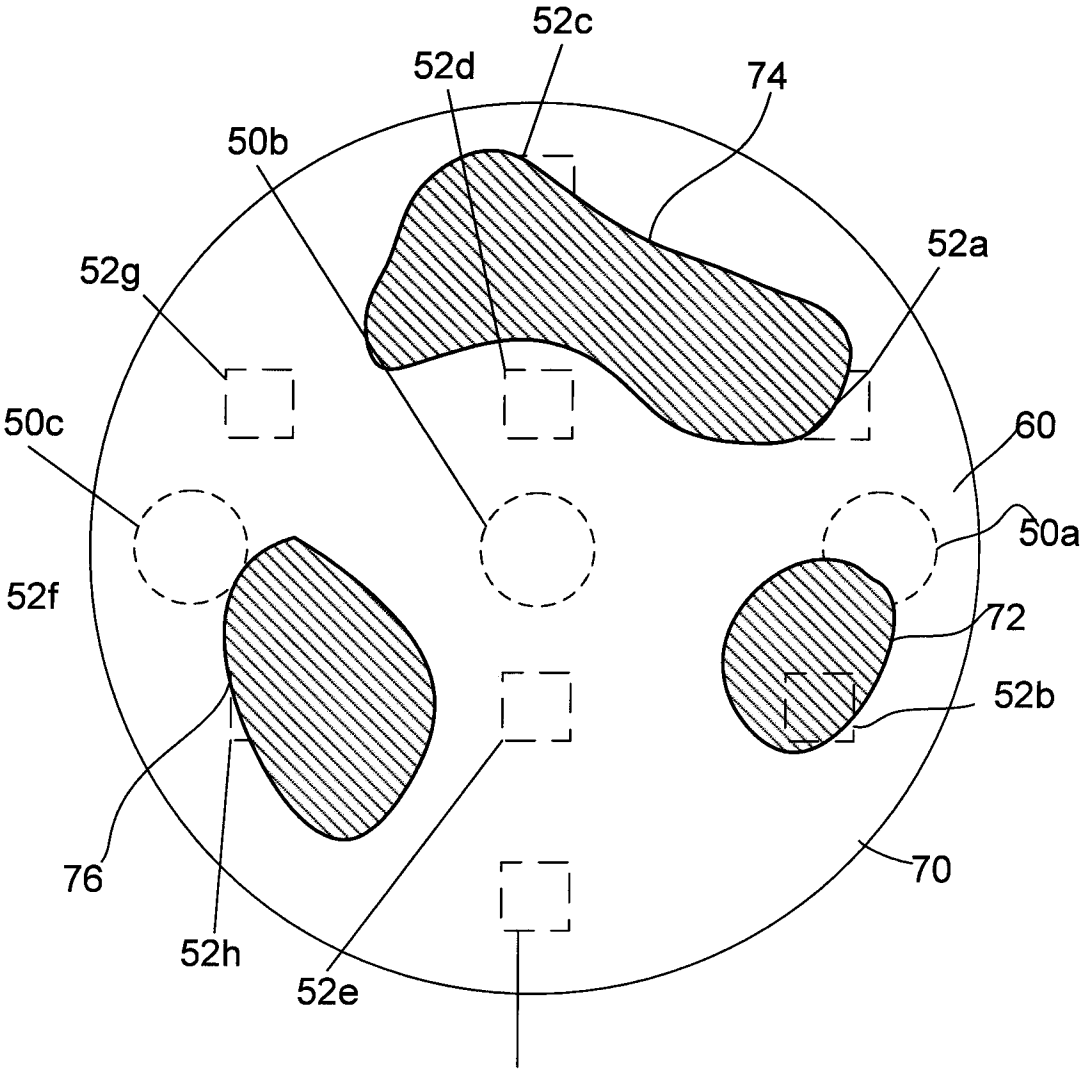
FIG. 2E is a diagrammatic representation of another embodiment of a set of food items positioned relative to an element network.

With reference to FIG. 2E, in some cases, food may be placed in the oven cavity in a manner that does not allow for proper heating of the food given a specific configuration of active and passive element locations. For example, given the configuration of the EM element network depicted in FIG. 2E, it may not be optimal to heat food items 72 and 74 if placed in the oven as illustrated in FIG. 2E. According to one embodiment, an oven may include a rotating plate driven by a servomotor. The position of the plate can be rotated so that each food item to be heated differently can be placed in a different heating area. For example, plate 70 can be rotated from the configuration of FIG. 2E to the position in FIG. 2D to allow for proper heating of food items 72 and 74.

Figure 3:
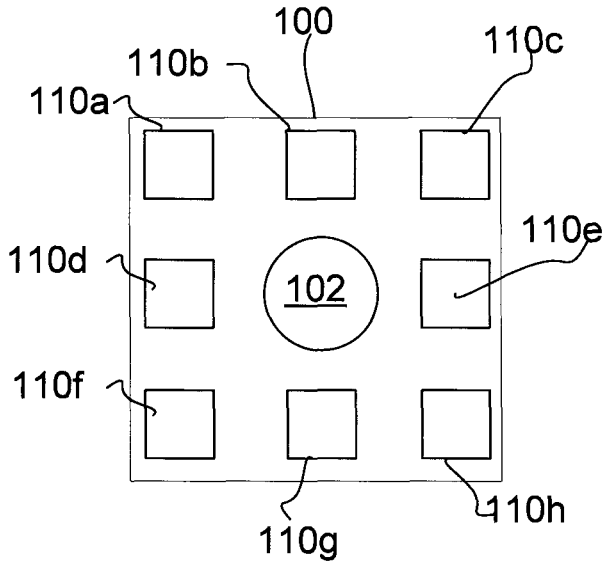
FIG. 3 is a diagrammatic representation of one embodiment of a unit cell.

The network of active and passive elements illustrated in FIGS. 2A-2E is provided by way of example and not limitation and other configurations of active and passive elements may be used in a heating system, such as heating system 12. FIG. 3, for example, is a diagrammatic representation of one embodiment of a unit cell 100 comprising an active element 102, which can be an example of an active element 18, and a plurality of passive elements 110 (individually passive elements 110*a*-110*h*), which can be examples of passive elements 19. According to one embodiment, active elements 102 may be active resonators and passive elements 110 may be passive resonators. A plurality of unit cells may be positioned on the floor of the microwave cavity (e.g., cavity 16 of FIG. 1).

According to one embodiment, active element 102 is configured to produce a 2.4-2.5 GHz polarized electromagnetic field. For example, active element 102 may be configured to produce a RF 2.4 GHz polarized electromagnetic field. Furthermore, while a microwave cavity may have a number resonant modes, active element 102 is selected not to create radiating waves and not excite resonant modes inside the metal oven cavity (not excite the cavity's resonant modes). According to one embodiment, each active element 102 is configured to produce an electromagnetic field of a selected volume above the element 102 and no other energy excitations in the microwave.

The power, amplitude and phase of the power signals driving active element 102 can be configured to create various power and polarization schemes. According to one embodiment, multiple amplifiers are connected to active element 102 and can drive active element 102 to produce an electromagnetic field with vertical and horizontal components with independent amplitude and phase. By controlling the input signals, the horizontal and vertical amplitude and phase can be controlled to produce a variety of polarization schemes including horizontal polarization, vertical polarization, 45-degree-slant polarization, circular polarization or elliptical polarization.

Each passive resonator 110 is positioned to be within a region of active resonator 102 and can be controlled to selectively electromagnetically couple to the respective active resonator 102. As noted above, a heating system can be configured so that the electromagnetic fields produced by an active resonator do not escape into far fields. Passive resonators 110 can be spaced to be in the reactive near-field region or, in some cases, radiating near-field region of active resonator 102. In other embodiments, a passive element 110 may be positioned in cavity 16 such that the passive element 110 is in the far field region of an active element 102 with which it couples.

Passive elements 110 are terminated with variable impedance values. Each passive element may be coupled to an impedance control circuit that is controllable to vary the impedance of the respective passive element 110. In one embodiment, the impedance control circuit may comprise one or more circuit components between a respective passive element terminal and ground. According to one embodiment, the impedance control circuit may comprise a switch. When the switch is open, the corresponding passive element 110 terminal terminates to an open circuit with infinite impedance. When the switch is closed, the terminal impedance is near zero or other impedance controlled by the impedance control circuit. Based on the terminal impedance (s) applied to the passive element. The terminal impedance (s) of a passive element 110 may be controlled to selectively induce coupling of energy from an active element 102 with the passive element 110. In some embodiments, an impedance control circuit may comprise one or more components that are controllable to provide a range of impedance values. For example, a passive element 110 may be terminated by an impedance control circuit comprising a variable capacitor, variable capacitance diode (e.g., a varactor), a variable impedance MEMS, or other component that is controllable to control the impedance of the passive element 110. Thus, a control voltage or other control signal may be applied such that the passive element has a specific load and, hence, impedance. In some embodiments, one or more terminals of an active element 102 are also coupled to an impedance control circuit that can be controlled to further control the field generated by the active element 102.

According to one embodiment, passive elements 110 can have different polarizations. The polarization of a passive element 110 may be fixed or adjustable. For a passive element 110 with adjustable polarization, the polarization of the passive element 110 can be dependent on the impedances at multiple terminals of the passive element. According to one embodiment, a passive element 110 may have multiple terminals connected to impedance control circuits. The terminal impedance values for each terminal can be controlled to control the polarization of the passive element.

By way of example, but not limitation, passive elements 110*a* and 110*h* are 45-degree-slant polarized, passive elements 110*b* and 110*g* are vertical polarized, passive elements 110*c* and 110*f* are circular polarized and passive elements 110*d* and 110*e* are horizontal polarized. The active elements 102 and passive elements 110 of multiple unit cells can be controlled to create desired electromagnetic field patterns in the microwave cavity.

According to one embodiment, the signal power and polarization scheme of active element 102 is controlled by a microprocessor. The passive elements 110 are also polarized and, thus, each passive element 110 will only couple with energy from an active element 110 that is polarized the same. Consequently, a passive element 110 can be on, yet will not electromagnetically couple with an active element 102 that is not at the same polarization (see e.g., FIG. 2D). This gives a high degree of control over the shapes created and the ability to create multiple independent shapes within the same cavity.

Figure 4:
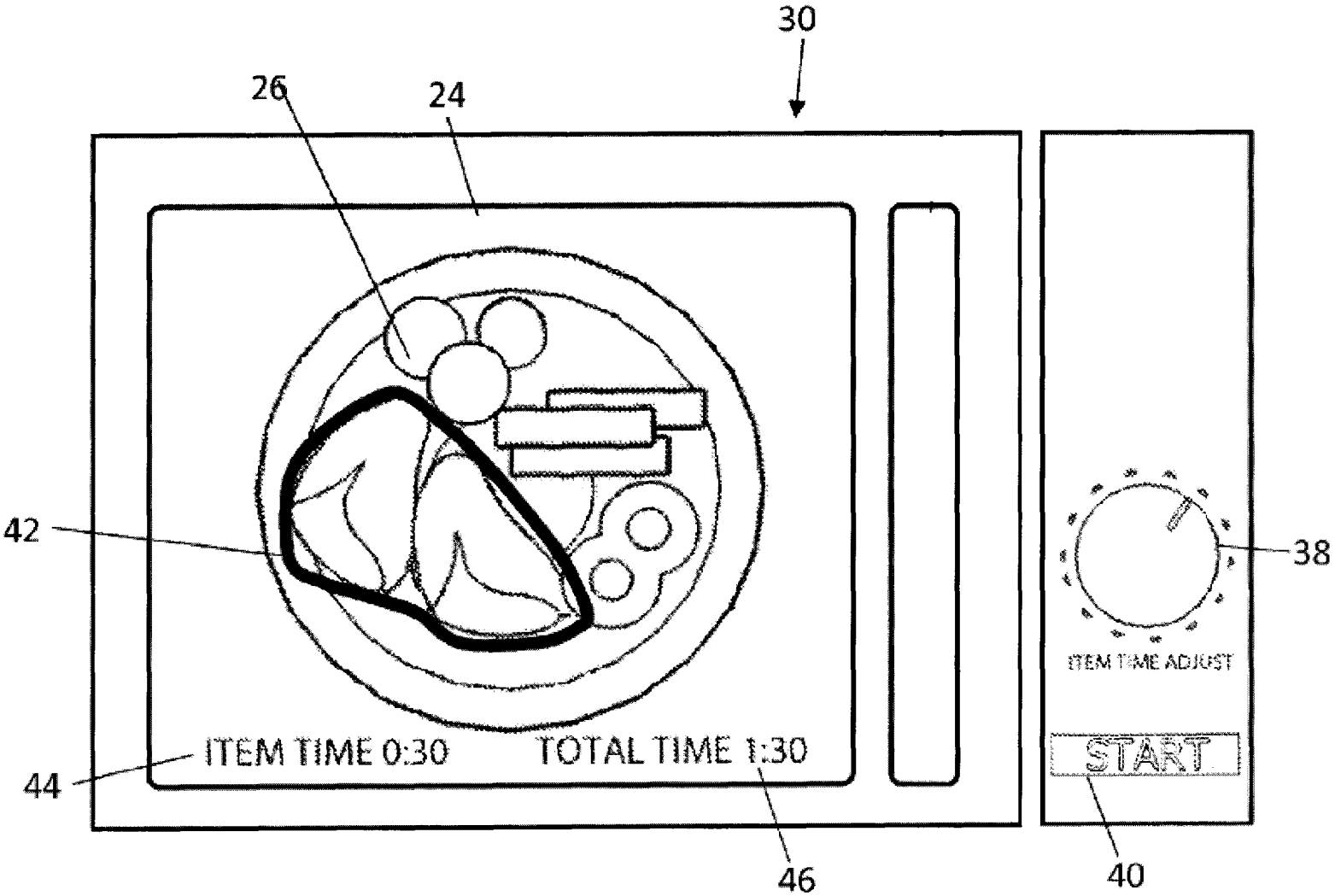
FIG. 4 is a front view of one embodiment of a selective heating oven.

Turning briefly to FIG. 4, one embodiment of a front view of a selective heating oven is illustrated. In the embodiment of FIG. 4, interface 24 comprises the touch screen display that displays an image 26 of the contents contained inside the cavity 16 of the system 12 captured by the camera 28.

To control which areas to heat, an input device such as an LCD touch screen, for example, may display a live image taken by a camera 28 mounted inside the oven facing the food 14. The user may input a selected area 42 corresponding to a physical area inside the cavity. The user may also input a time selection. The user may select which food items to heat by drawing circles or shapes around the food they desire to be heated on the LCD screen. For example, a user may select the area to be heated by highlighting that area with their finger on the touch screen display of interface 24. The highlighted area, called the selected area 42, corresponds to a physical area inside the cavity 16. A user may use the knob 38 to adjust the amount of time 44 that a user desires for the selected area 42 to be heated.

A user may repeat this process for other food items 14 or areas of a food item 14. Thus, different areas of a food item 14 can be heated for different periods of time, or temperatures, based on the desired selection of a user. The touch screen display 24 may display to a user the selected area time 44 and the total time 46 for all the food items 14 to be heated completely, based on the desired selection entered by a user. A user may then press the start button on panel 40 in order to direct the system to begin heating the food items based on the user-specified configurations.

According to one embodiment, a controller can receive the user's area selection from the interface 24 and time selection and convert the inputs into control signals to control active elements 18 and the impedance of passive elements 19. Using software and an embedded controller, the shapes or areas selected by the user may be converted into control signals that control power to the active elements 18 and impedance of passive elements 19 inside the oven.

Since the oven may be able to selectively heat different areas of a food plate to different temperatures, it may be agreeable to allow manufacturers of dinner foods, microwavable foods, to store information in the form of a machine readable code regarding the heat regions and temperatures of the food dish. For example, a vendor may sell a frozen food tray of steak and salad. The vendor may attach a machine readable code, to the packaging of the tray. When the tray is inserted into the oven, the camera 28 may detect and read the machine readable code. The information may include a heat map for the dish. In addition, the machine readable code's orientation may be captured. As such, the oven may now have information on how to heat the dish exactly as the vendor recommends without requiring the user to input any more data. The user may be prompted to hit the start button to begin the heating operation. The heating information stored in the sticker may be normalized to power levels and starting temperature of the food items in some embodiments. As such, the correct amount of power may always be delivered to the food items independent of the power level of the receiving oven and/or the initial starting temperature of the food. In other words, a low power oven may heat items longer than a high power oven to achieve the desired heat levels. Moreover, food that is heated starting from a cold temperature (e.g., from a fridge) may be heated using more power than food starting from room temperature.

Storage of data on a machine code, or a machine readable printed sticker, may be limited to several kilobytes of data. To enable storage of the heat map data, the information may be placed in a compressed format, such as a vector format. In the vector format method, each shape may be represented via a set of points. Each point's coordinates may be stored in a data file. When the system processor (e.g., microcontroller 204, described below) receives the data, it may be able to rebuild the shape. For example, assume the following vector text stored on the machine readable code: "S 0,0 5,0 5,5 0,5 h25" This code represents a square shape starting at coordinates 0-0 and having corners at the other 3 coordinates. The heat level may be denoted by the "h25" (i.e., a heat level of 25). As shown, using 21 characters of space and consuming roughly 21 bytes, one may represent a square shaped heat region and its power level. The data size may be further reduced through data compression. The same methodology can be applied to incorporate complex shapes, donated by points, and thus various heat maps. After the shapes are obtained, the orientation of the machine readable code may be used to rotate the heat map image to match the food. This method is similar to the open standard Scalable Vector Graphics (SVG) specification developed by the World Wide Web Consortium (W3C). However, an SVG format file may have a larger file size than the example file, and SVG does not include orientation data. As such, although the machine readable code can only fit a small footprint of data, through efficient encoding techniques, the machine readable code may convey detailed heat map information to the oven. Vendors (e.g., vendors of frozen or reheatable meals) may create and store heat map data onto printable media that can be consumed by the oven's microprocessor through a camera.

In another example, heat map data may be obtained from stored heat map data on an online database. The camera inside the microwave oven may scan the machine readable code, or other identification codes, on the packaging. The internet connected oven may look up the machine readable code in an online database including heat maps and download the heat map data. For example, the machine readable code may be linked to a specific heat map in the database. The oven may use the orientation of the machine readable code to orient the downloaded heat map as described above. Then, the oven may heat the food per the vendor's specification. This selective heating capability coupled with the heat map sticker may allow manufactures to create a wide array of auto heating food combinations for use with the described ovens.

Figure 5:
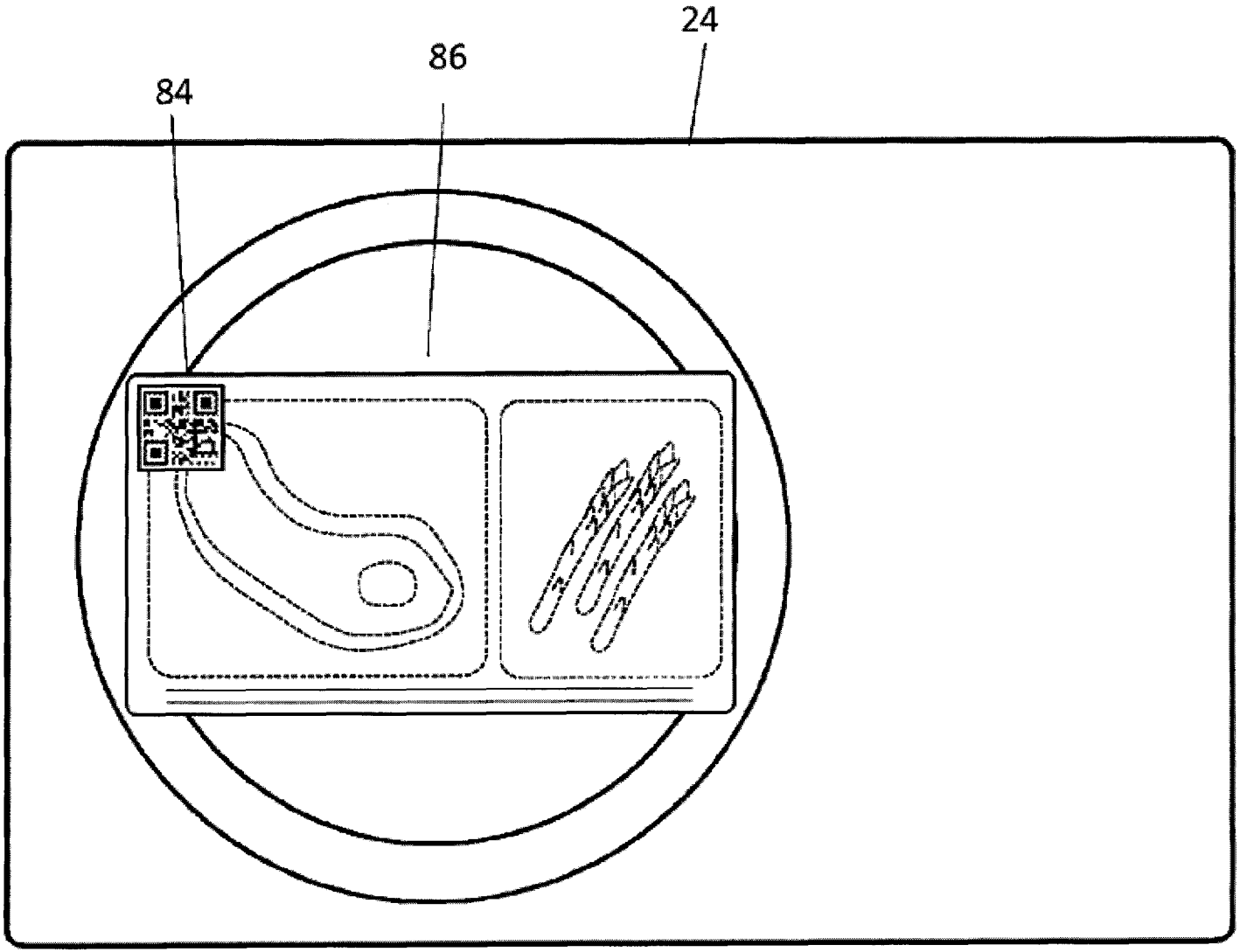
FIG. 5 illustrates one embodiment of a machine readable code disposed on a tray.

Thus, in one embodiment, the controller may convert a machine readable code or a user entered code into control signals. FIG. 5 illustrates a tray having a machine readable code 84 disposed thereon. As described above, the device 12 may use the camera 28 to read a machine readable code 84 for heating instructions and determine food orientation based on the orientation of the machine readable code 84. The interface 24 may display an image of the machine readable code 84 and/or an image 86 of the orientation of the food inside the cavity 16 of the system 12 captured by the camera 28. In some embodiments, cook time and power data as determined by the machine readable code may also be displayed. The oven may allow the user to confirm the information and/or to initiate the cooking process.

Figure 6:
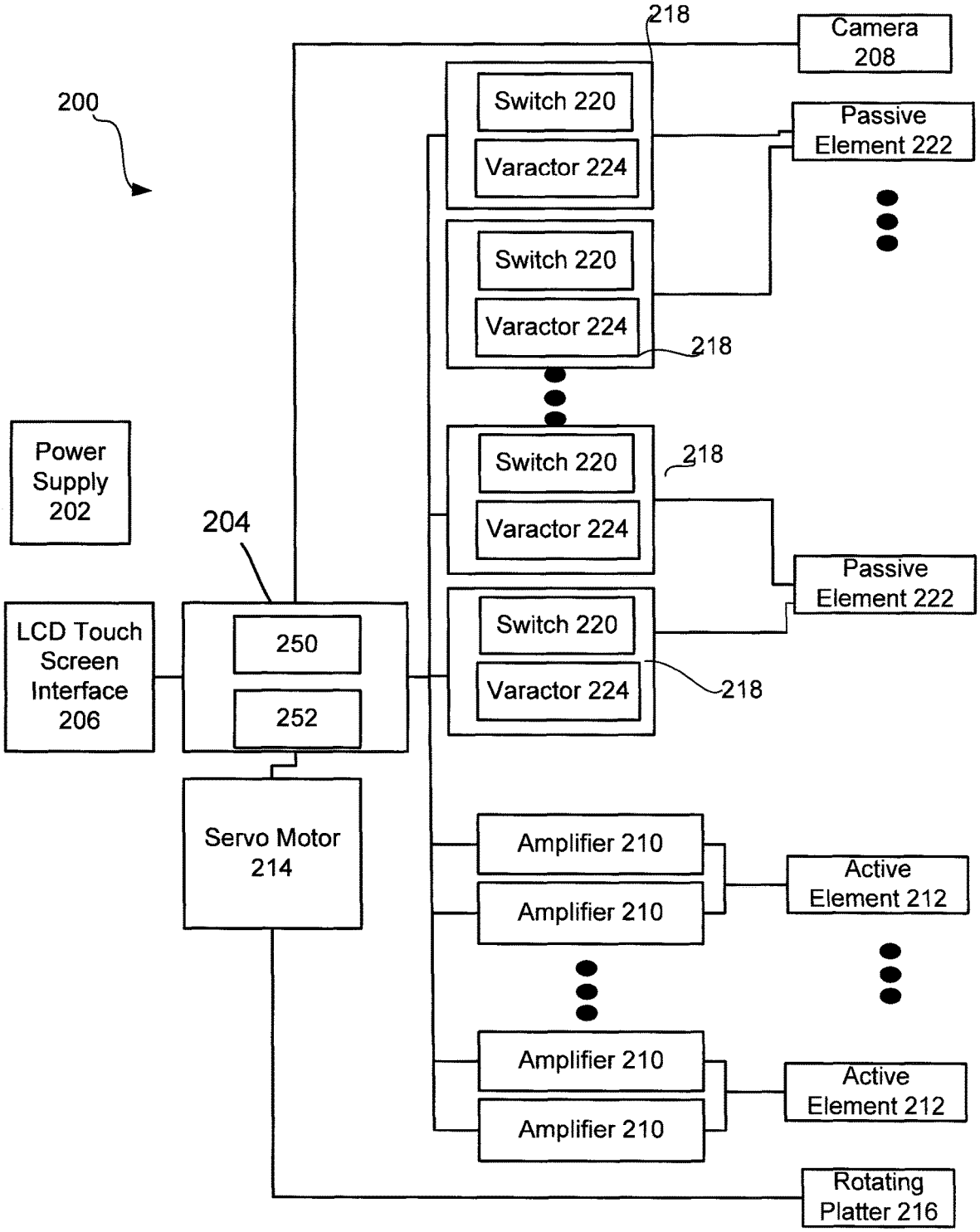
FIG. 6 is a block diagram of one embodiment of an oven control circuit.

FIG. 6 is a block diagram of an oven control circuit 200 according to an embodiment of the disclosed systems and methods. The circuit 200 may control the system to perform the functions described above. The circuit 200 may be powered by power supply 202, which may be configured to supply power from a home AC circuit, a battery, or any other source. The circuit 200 may include a microcontroller 204, which may be any kind of processor capable of interacting with and/or controlling the other circuit 200 components. According to one embodiment, microcontroller 204 can comprise a processor 250 coupled to a computer readable memory 252 storing instructions executable by processor 250.

Control circuit 200 may further include impedance control circuits 218. Impedance control circuits 218 can comprise components that are controllable to control the terminal impedance of respective passive elements 222. In the embodiment illustrated, the impedance control circuit includes a switch 220 and varactor 224. The switches 220 may be opened to terminate the respective terminals of passive element 222 with an infinite impedance value and closed to terminate the respective terminals of passive element 222 with another impedance value. A control voltage can be applied to the varactor 224 to control a terminal impedance value of the passive element through a range of values when the respective switch 220 is closed. By controlling the impedance at multiple terminals of a passive element 222, the polarization of the passive element can be controlled. The illustrated impedance control circuit 218 is provided by way of illustration and not limitation. In other embodiments, the impedance control circuit may simply comprise a controllable switch that controls the terminal impedance value of the passive element between infinite and another value (e.g., approaching zero). The impedance control circuit may comprise a variable capacitor, variable capacitance diode (e.g., a varactor), a variable impedance MEMS, or other component that is controllable to control the impedance of the passive resonator element through a range of impedances.

The microcontroller 204 may receive image data from a camera 208 (e.g., camera 28 of FIG. 1), and display the image on the touch screen interface 206 (e.g., interface 24 of FIG. 1). Via the interface 206, a user may enter heating instructions. In another embodiment, the microcontroller 204 may receive a machine readable code or other code and access heating instructions contained in the code or associated with the code in memory 252. In another embodiment, the microcontroller 204 may connect to the Internet and download heating instructions based on the machine readable code. The microcontroller 204 may use these instructions to selectively control amplifiers 210 to control the power, amplitude and phase of the signals to the active elements 212, for example, active EM elements 18, 50, 102. The microcontroller 204 may also use these instructions to control impedance control circuits 218 to control the terminal impedance values of passive elements 222. For example, microcontroller 204 may selectively open and close switches 220 in a network of switches to switch passive elements 222 on or off (e.g., to selectively switch passive elements 19, 52, 110 on or off). Microcontroller 204 may also use the instructions to apply load to a system of varactors 224 to control the impedance of passive elements 222. The control of the active elements 212 and passive elements 222 can be done in real-time.

Microcontroller 204 can thus receive inputs from the oven user via a touch screen display about the desired shape of the area to be heated. The microprocessor can execute instructions in memory 252 to convert the shape data into a sequence of power, polarization, and impedance values to produce the heating shape desired by the user. The microprocessor may also track how much time each region of food is subject to the electromagnetic fields, and then adjust the energy shapes pattern to provide even heating of the desired food item accordingly.

To operate in full heating mode, where all items in the cavity are heated, the active elements 210 may be circularly polarized or swept and thus couple with all the passive elements 222. In another embodiment of the system, the user may desire more than one heat shape and to various power levels. For example, a dish with steak and broccoli where the user desires to heat the steak for 30 seconds but the broccoli for only 10 seconds (or less heat). In this scenario, the microcontroller 204 can take the user's input and create the necessary power, polarization, and impedance values and adjust them over time to produce a high heat zone for the steak and a lower heat zone for the broccoli. Thus, in addition to creating heat shapes within the cavity, the system is also able to control the amount of power or the amount of time the power is applied to these different shapes. For example, through modulating the power to the elements via pulse width modulation using a specific duty cycle that determines the effective power emanated from the active elements for a specific shape.

The microcontroller 204 may also control servomotor 214 to move the rotating platter 216 on which the food is placed as well as receive food location data based on the position of the servomotor 214. The microcontroller may include a map of the locations of the active and passive elements. As discussed with respect to FIG. 4, some embodiments may allow a user to select the items they desire to heat by drawing an outline around the food item or area within the oven. A controller then may close the loop created by the outline and fill in the entire shape. The resulting shape may be made of cells or pixels that represent the food. Each pixel may have a polar coordinate made up of an angle and a distance from the center, or a radius. Microcontroller 204 can determine the number of items to be separately heated (or not heated) based on user input and rotate the plate so that the food is positioned relative to the network of elements to allow the appropriate number of electromagnetic fields to be created.

According to one embodiment, the food may be placed on an intelligent rotating platter 216. The rotating platter 216 may be connected to servomotor 214 driven by microcontroller 204. Having a rotating platter 216 provides yet another degree of control of where to apply heat to the food. For example, instead of moving the energy pattern around via the active and passive elements, the system can use the rotating platter 216 to physically move the food over the elements and apply the correct heat shape for more precise heating. Moreover, the addition of a rotating platter 216 allows cost savings by reducing the number of active elements required to create the necessary coverage and possible heat shapes. For example, the rotating platter will be utilized to move the food to reach a single active element or particular active element in an oven with multiple active elements.

Examples of additional embodiments may allow a user to integrate the system 12 with other devices of the user or another user, including communication devices (e.g., smart phones, tablets, computers, etc.), to allow for increased functionality and ease of use, as well as the ability to share the contents or access rights to the system with another user. For example, using WiFi or Bluetooth protocols, the system may communicate with an application installed on the user's handheld smart phone and may display an image of the food inside the cavity on their smart phone. The camera 208 inside the oven may capture an image of the food that may be read by the microcontroller 204. The microcontroller 204 may be configured to interface with a wireless module, such a W-Fi module, which may be added to the circuit of FIG. 6, for example. Through the wireless module, the microcontroller 204 may communicate with an application installed on the user's smartphone. The application may display the image captured by the oven camera on screen. The user may then use his fingers to select the heating regions and heat settings and send this data back to the microcontroller 204 to start the oven heating operation. The data may get transmitted back to the oven so the heating operation may begin. Upon completion of the heating cycle, the microcontroller 204 may transmit a message to the user that may serve as a notification that the food is ready. In addition, the smart phone application may notify the user when important events occur such as the food being left, or forgotten, in the oven for longer than some predetermined length of time. In another example, the microcontroller 204 may transmit calorie related information to a user's smartphone device. After completing the calorie tracking process described previously, the microcontroller 204 may send the resulting calorie calculation and nutritional value of food to the user's smartphone. In addition, the microcontroller 204 may also transmit an image captured of the food. As such, the user may now have a log of all food items and their nutritional information stored in a log on their smartphone device. This may be beneficial for users who keep track of their caloric intake or for users on a health management diet.

Figure 7:
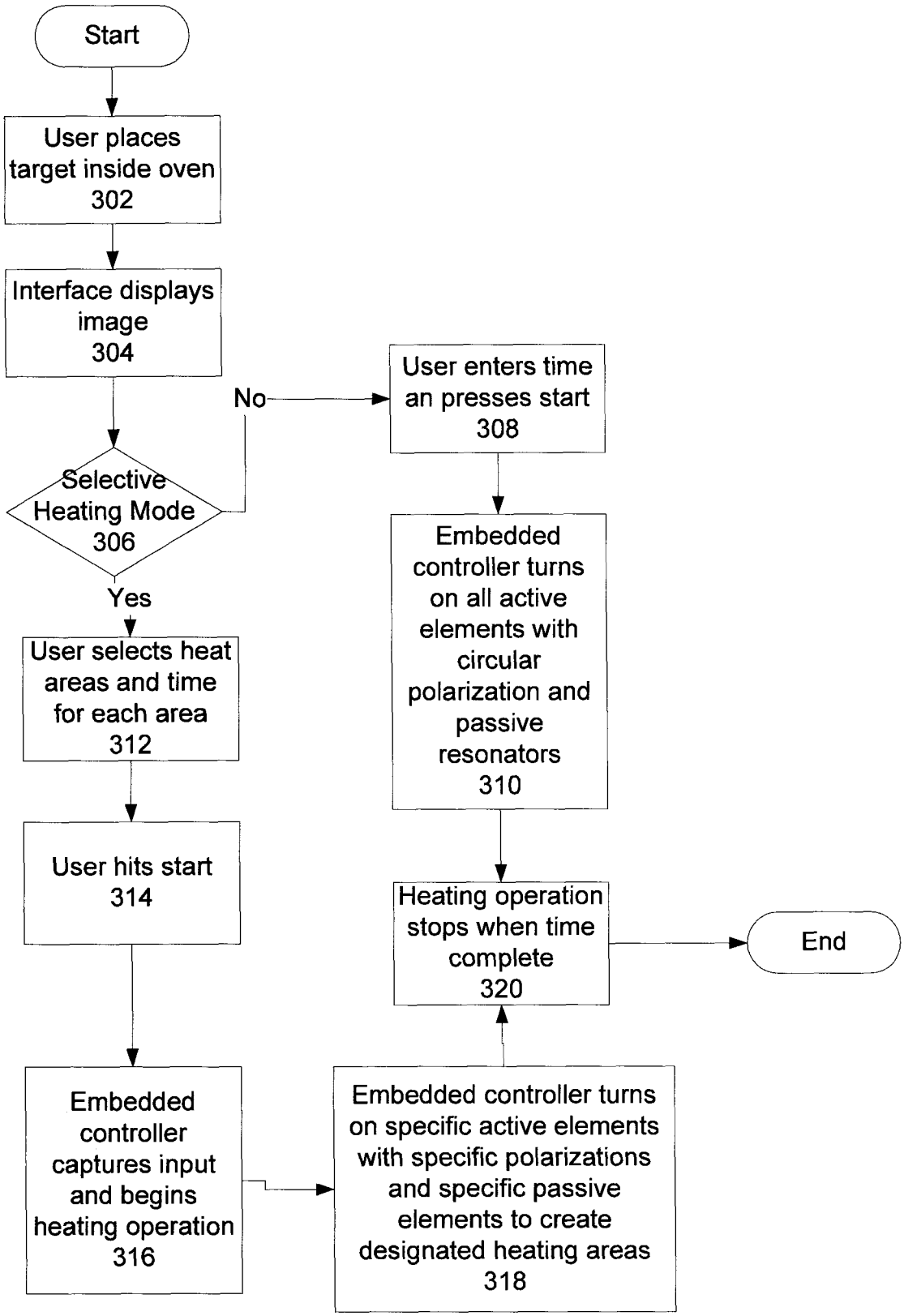
FIG. 7 is a flow chart illustrating one embodiment of a selective heating process.

FIG. 7 is a flow chart illustrating one embodiment of a system for selectively heating food. A user may place food inside the oven (step 302), and the image of the food taken by the camera may be displayed on the display screen (step 304). The user may choose to heat the entire plate or may choose selective heating mode (step 306). If the entire plate is to be heated, the user may enter a heating time, power, and/or other settings and press start (step 308). The system controller (e.g., microcontroller 204) may turn on all the active elements and passive elements for the specified time (step 310). The active elements may be circularly polarized or swept and thus couple with all the passive elements regardless of the polarization of the passive elements. When the time is elapsed, the heating operation may end (step 320).

If the user chooses selective heating mode (step 306), the user may select heat areas and, in some cases, specify time and/or power for each area (step 312). The user may start the heating cycle (step 314). The controller may receive the user input and start the heating operation 216. The controller may generate control signals to power specific active elements and switch on selected passive elements at specific times as required by the user input heating areas (step 318). For example, the controller can generate signals to amplifiers to power signals to drive active elements in which the power signals are configured to create various polarization schemes. In addition, the controller can control a switch network to selectively switch on passive elements having the same polarization as the active elements being driven. The controller may also apply control voltages to varactors to control the impedance of the passive elements. The controller can thus control the active and passive elements to create electromagnetic fields in the oven to create desired heat regions. When all areas are heated as desired, the heating operation may end (step 320).

Embodiments described herein can create various heat patterns using a network of active and passive elements through adjusting the polarization, power, impedance values and positions of the elements. As the number of active or passive elements in a particular oven increases, the number of possible energy patterns also increases. Because passive elements are relatively more economical than active elements, an oven may have a plurality of passive elements for each active element, thus providing a high degree of control over the electromagnetic field. The configuration and placement of active and passive elements can be determined based on the application, required degree of control and cost.

In the example embodiments illustrated above, the active and passive elements are placed on the floor of the oven cavity. However, the passive and active elements may be on different horizontal planes and may be oriented in any direction. For example, they may be placed above each other to further improve coupling effects or utilize cavity floor space more efficiently. In some embodiments, the network of active and passive elements may include elements placed on the bottom, side or top inner walls of the cavity, thus allowing for more degrees of energy distribution, including on the vertical axis. For example, active elements (e.g., active elements 18, 50, 102) on the bottom floor can couple energy with the passive elements on the top wall, thus creating an electromagnetic field going across the food in the vertical direction. Active and passive elements can be placed in any number of patterns. Thus, systems are able to generate any number of heat patterns to match the desired heating area with a high degree of control.

In an embodiment where the elements are placed beneath the platter, the energy passes through the platter to reach the food. As such, the material and design of the platter can be modified to provide further control over the electromagnetic field. For example, the plate may be made of a polycarbonate material to allow the energy to pass with minimal alteration. In another example, the platter can be made of a metamaterial that intentionally focuses the energy or alters the energy's radiation pattern or properties. In another example, the oven may have interchangeable platters based on what the user desires to achieve. In another example, the platter may be controlled by a servo motor to further provide a degree of control over the EM patterns. The design of the platter is another parameter that may be adjusted that also provides another degree of control.

According to another embodiment, one or more active or passive elements are mounted upon an actuated mechanical platform that allows movement of the radiation pattern mechanically in addition to electrically. This platform may be on the floor, ceiling side-walls or inside the cavity. This may also provide further degree of control.

In another embodiment of the system, the microcontroller accounts for convection and conduction effects inside the food and oven cavity. The control algorithm may compensate for such effects over time to provide the user with a uniformly heated dish per their specification.

As one skilled in the art can appreciate, a computer program product implementing control logic disclosed herein may comprise one or more non-transitory computer readable media storing computer instructions translatable by one or more processors in a computing environment. ROM, RAM, and HD are computer memories for storing computer-executable instructions executable by the CPU or capable of being compiled or interpreted to be executable by the CPU. Suitable computer-executable instructions may reside on a computer readable medium (e.g., ROM, RAM, and/or HD), hardware circuitry or the like, or any combination thereof. Within this disclosure, the term "computer readable medium" is not limited to ROM, RAM, and HD and can include any type of data storage medium that can be read by a processor. For example, a computer-readable medium may refer to a data cartridge, a data backup magnetic tape, a floppy diskette, a flash memory drive, an optical data storage drive, a CD-ROM, ROM, RAM, HD, or the like. The processes described herein may be implemented in suitable computer-executable instructions that may reside on a computer readable medium (for example, a disk, CD-ROM, a memory, etc.). Data may be stored in a single storage medium or distributed through multiple storage mediums, and may reside in a single database or multiple databases (or other data storage techniques).

Embodiments described herein can be implemented in the form of control logic in software or hardware or a combination of both. The control logic may be stored in an information storage medium, such as a computer-readable medium, as a plurality of instructions adapted to direct an information processing device to perform a set of steps disclosed in the various embodiments. Based on the disclosure and teachings provided herein, a person of ordinary skill in the art will appreciate other ways and/or methods to implement the invention.

Although the invention has been described with respect to specific embodiments thereof, these embodiments are merely illustrative, and not restrictive of the invention as a whole. Rather, the description is intended to describe illustrative embodiments, features and functions in order to provide a person of ordinary skill in the art context to understand the invention without limiting the invention to any particularly described embodiment, feature or function, including any such embodiment feature or function described in the Abstract or Summary. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention.

Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can be implemented in a more separated or integrated manner, or even removed or rendered as inoperable in certain cases, as is useful in accordance with a particular application. Additionally, any signal arrows in the drawings/figures should be considered only as exemplary, and not limiting, unless otherwise specifically noted.

Reference throughout this specification to "one embodiment", "an embodiment", or "a specific embodiment" or similar terminology means that a particular feature, structure, or characteristic described in connection with the embodiment is included in at least one embodiment and may not necessarily be present in all embodiments. Thus, respective appearances of the phrases "in one embodiment", "in an embodiment", or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

As used herein, the terms "comprises," "comprising," "includes," "including," "has," "having" or any other variation thereof, are intended to cover a non-exclusive inclusion. For example, a process, product, article, or apparatus that comprises a list of elements is not necessarily limited only to those elements but may include other elements not expressly listed or inherent to such process, product, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms. Language designating such nonlimiting examples and illustrations includes, but is not limited to: "for example," "for instance," "e.g.," "in one embodiment."

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A selective heating device comprising:

a chamber configured to contain a target to be at least partially heated;

an active electromagnetic (EM) element;

a first passive EM element in the chamber, the first passive EM element capable of electromagnetically coupling to the active EM element and having a first passive EM element polarization, wherein the active EM element and first passive EM element are controllable to selectively heat a portion of the target and wherein the active EM element is controllable to generate, in the chamber, a first electromagnetic field having a first electromagnetic field polarization that aligns with the first passive EM element polarization; and a second passive EM element in the chamber, the second passive EM element configurable to have a second passive EM element polarization that is different than the first passive EM element polarization, the second passive EM element configurable to couple to a second electromagnetic field that aligns with the second passive EM element polarization.

2. The selective heating device of claim 1, wherein the active EM element and the first passive EM element are controllable to:

selectively heat a first portion of the target at a first energy level for a first period of time;

selectively heat a second portion of the target at a second energy level for a second period of time; and refrain from heating a third portion of the target.

3. The selective heating device of claim 1, wherein the first passive EM element has a controllable impedance.

4. The selective heating device of claim 3, wherein the controllable impedance is a terminal impedance.

5. The selective heating device of claim 3, wherein the controllable impedance is adjustable through a range of impedances.

6. The selective heating device of claim 1, further comprising an impedance control circuit to control a terminal impedance of the first passive EM element.

7. The selective heating device of claim 1, wherein the active EM element is controllable to have a plurality of polarizations and the first passive EM element polarization is aligned with at least one of the plurality of polarizations.

8. The selective heating device of claim 7, wherein the second passive EM element polarization aligns with at least one of the plurality of polarizations.

9. The selective heating device of claim 1, further comprising a control circuit configured to receive a heating instruction and control a power signal to the active EM element and a terminal impedance of the first passive EM element to selectively heat the portion of the target.

10. The selective heating device of claim 1, wherein the active EM element comprises an active resonator and the first passive EM element comprises a passive resonator.

11. The selective heating device of claim 1, wherein the active EM element is a plurality of active EM elements controllable to generate electromagnetic fields in the chamber.

12. A selective heating device comprising:

a chamber configured to contain a target to be at least partially heated;

an active resonator, the active resonator controllable to generate, in the chamber, a first electromagnetic field having a first electromagnetic field polarization;

a first passive resonator, the first passive resonator capable of coupling with the active resonator and having a first passive resonator polarization controllable to align with the first electromagnetic field polarization; and a second passive resonator having a second passive resonator polarization controllable to align with a second electromagnetic field polarization that is different than the first electromagnetic field polarization; and wherein the active resonator and first passive resonator are controllable to selectively heat a portion of the target.

13. The selective heating device of claim 12, wherein the active resonator and the first passive resonator are controllable to:

selectively heat a first portion of the target at a first energy level for a first period of time;

selectively heat a second portion of the target at a second energy level for a second period of time; and refrain from heating a third portion of the target.

14. The selective heating device of claim 12, wherein the first passive resonator has a controllable impedance.

15. The selective heating device of claim 14, wherein the controllable impedance is adjustable through a range of impedances.

16. The selective heating device of claim 12, further comprising an impedance control circuit to control a terminal impedance of the first passive resonator.

17. The selective heating device of claim 12, wherein the active resonator is controllable to have a plurality of polarizations, wherein each of the first passive resonator polarization and the second passive resonator polarization is controllable to align with at least one of the plurality of polarizations.

18. The selective heating device of claim 12, further comprising a control circuit configured to receive a heating instruction and control a power signal to the active resonator and a terminal impedance of the first passive resonator to selectively heat the portion of the target.

19. The selective heating device of claim 12, wherein the active resonator is a plurality of active resonators in the chamber.

* * * * *